US008714864B2

(12) United States Patent
Wojtowicz et al.

(10) Patent No.: US 8,714,864 B2
(45) **Date of Patent: *May 6, 2014**

(54) INSIDE WRAP POST COUPLER WITH ASSEMBLY ASSIST

(75) Inventors: David J. Wojtowicz, Orland Park, IL (US); Thomas St. Germain, Bridgeview, IL (US); Mitchell Liss, Northbrook, IL (US); Al Dunaj, Chicago, IL (US)

(73) Assignee: Edsal Manufacturing Co., Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/184,511

(22) Filed: Jul. 16, 2011

(65) Prior Publication Data

US 2011/0272543 A1 Nov. 10, 2011

Related U.S. Application Data

(63) Continuation-in-part of application No. 11/044,689, filed on Jan. 27, 2005, now Pat. No. 8,585,313.

(51) Int. Cl.
*B25G 3/00* (2006.01)
*E21B 17/043* (2006.01)
*F16D 1/00* (2006.01)

(52) U.S. Cl.
USPC ..... 403/286; 403/109.2; 403/109.8; 403/293; 211/191; 211/194; 256/DIG. 5

(58) Field of Classification Search
USPC ..... 403/109.2, 109.8, 283, 286, 292, 293, 403/295, 300, 305, 353, 393; 211/182, 211/189–192, 194; 52/582.1, 848; 256/47, 256/DIG. 5
See application file for complete search history.

(56) References Cited

U.S. PATENT DOCUMENTS

| | | | | | |
|---|---|---|---|---|---|
| 2,226,763 | A * | 12/1940 | Geib et al. | ..... | 446/116 |
| 3,056,507 | A * | 10/1962 | Squires, Jr. et al. | ..... | 108/106 |
| 4,598,512 | A * | 7/1986 | Chapman | ..... | 52/165 |
| 4,967,916 | A * | 11/1990 | Handler et al. | ..... | 211/187 |
| 5,971,175 | A * | 10/1999 | Bustos | ..... | 211/187 |
| 6,209,155 | B1 * | 4/2001 | Epstein et al. | ..... | 5/201 |
| 6,397,413 | B2 * | 6/2002 | Epstein et al. | ..... | 5/201 |
| 6,839,920 | B2 * | 1/2005 | Schulte | ..... | 5/200.1 |

* cited by examiner

*Primary Examiner* — Daniel P. Stodola
*Assistant Examiner* — Nahid Amiri
(74) *Attorney, Agent, or Firm* — Wood, Herron & Evans, LLP

(57) ABSTRACT

A post coupler includes coupler flanges, reverse bend flanges extending therealong and tapered end projections extending longitudinally from said coupler flanges defining ends of the coupler, the length of the reverse bend flanges being less than the overall coupler length between ends of the rounded end projections, and the reverse bend flanges preferably oriented along outer surfaces of said coupler flanges.

4 Claims, 10 Drawing Sheets

INSIDE WRAP POST COUPLER WITH ASSEMBLY ASSIST

PRIORITY CLAIM

This application is a Continuation-in-Part of U.S. patent application Ser. No. 11/044,689 filed Jan. 27, 2005 now U.S. Pat. No. 8,585,313, published under Publication No. US2006/0163438, entitled "POST COUPLER", both of which are expressly incorporated herein by reference in their entirety.

RELATED PATENT APPLICATIONS

This application is related to co-pending applications filed on even date herewith and including:

- U.S. application Ser. No. 29/397,486 entitled "DESIGN FOR WRAPPED POST COUPLER";
- U.S. application Ser. No. 29/397,490 entitled "DESIGN FOR POST COUPLER WITH SCALLOPED EDGES";
- U.S. application Ser. No. 29/397,488 entitled "DESIGN FOR POST COUPLER WITH KEYHOLE OPENING";
- U.S. application Ser. No. 13/184,509 entitled "OUTSIDE WRAP POST COUPLER WITH ASSEMBLY ASSIST";
- U.S. application Ser. No. 13/184,506 entitled "OUTSIDE WRAP POST COUPLER ACCOMMODATING BEAM RIVET";
- U.S. application Ser. No. 29/397,487 entitled "DESIGN FOR POST COUPLER WITH INSIDE WRAP";
- U.S. application Ser. No. 29/397,485 entitled "DESIGN FOR POST COUPLER WITH SCALLOPED EDGES AND INSIDE WRAP";
- U.S. application Ser. No. 29/397,489 entitled "DESIGN FOR POST COUPLER WITH KEYHOLES AND INSIDE WRAP";
- U.S. application Ser. No. 13/184,507 entitled "INSIDE WRAP POST COUPLER ACCOMMODATING BEAM RIVET";
- U.S. application Ser. No. 29/397,491 entitled "DESIGN FOR INNER POST COUPLER".

All these related applications are herewith expressly incorporated herein by reference as if fully set out herein.

FIELD OF THE INVENTION

This invention relates to shelving and to post couplers used in coupling shelf supporting columns end-to-end in a shelving unit and facilitating assembly of the coupler to post sections for forming a unitary corner post useful in the shelving unit.

BACKGROUND OF THE INVENTION

Prior post couplers have been used to couple post ends together to form an elongated, unitary corner post or column used with other corner posts to support a plurality of shelves mounted on elongated brackets or beams connected to and extending horizontally between the corner posts. Typically, the posts are of angled construction defined by flanges at 90° to each other and are provided with keyhole-shaped slots for receiving rivets extending from the elongated shelf beams which are oriented horizontally between the posts. The rivets interlock the beams to the posts to define a ladder-like shelf frame on which shelves are supported. These beams can thus be adjusted vertically, up and down the posts, to provide for a desired vertical spacing between shelf members supported by the beams.

It will be appreciated that prior couplers in other fields have, and present, ends terminating in edges which are relatively flat or straight. Components fitting into these, and particularly ends thereof, have relatively flat or straight linear edges, these ends being inserted into the gaps defined by flanges of the couplers for securing the sections end-to-end in abutting relation.

Accordingly, in assembly of a coupler to two post sections, the section ends are inserted into the coupler into gaps formed by respective flanges of the coupler. The flange ends define slot-shaped openings into the gaps. If the post section being inserted into the slot, and gap, is not well-aligned with the longitudinal orientation of the coupler which wraps around the post section from the inside thereof, the straight post edge can engage a straight flange edge defining the slot or gap opening, preventing or rendering difficult the telescoping of the coupler onto the post section. The straight edges of the two components engage and obstruct slipping the post into the gaps of the coupler. Similar assembly difficulties are encountered if the flanges of the post sections and the flanges of the coupler are not formed with precisely similar included angles therebetween.

Accordingly, it is one objective of the invention to provide a post coupler which facilitates the assembly together of the coupler and a post section, where the coupler wraps around the post section from the inside.

A further objective of the invention has been to provide a post coupler facilitating the assembly of two post components thereto and from two respective opposed ends of the coupler, where the coupler wraps around the post components from the inside.

A further objective of the invention has been to provide an easily assembled shelving unit wherein the structure of a post coupler for coupling respective ends of post sections forming a corner post in the shelving unit guides the post section ends into the coupler without undue interference between end edges of the coupler and the post section ends, and where the coupler wraps around the post section from the inside.

SUMMARY OF THE INVENTION

To these ends, a coupler according to the invention defines major coupler flanges and reverse bend coupler flanges defining a component receiving gap therebetween. The major coupler flanges have end edges extending longitudinally beyond end edges of the reverse bend flanges and are curved or tapered into those reverse bend flange end edges. Thus, the coupler end defined by the end edges of the respective flanges is not flat, but is at least non-linear or tapered at the slot facilitating entry of the component to be coupled. Thus, the invention includes a pronounced, rounded or tapered projection extending from each respective coupler end. The rounded or tapered surface of these projections flows between the respective coupler flanges and the post-receiving slot formed by these and reverse bend flanges of the coupler is not flat or straight, but is non-linear or tapered.

Accordingly, the flat post-section end edges do not have to be in exact alignment with the slot, formed by coupler flanges, to receive the post section ends. Instead, a corner of the post section, where the post flanges meet, is moved relatively onto the coupler projection and the projection surfaces guide the post end into the coupler gaps confining and progressively aligning the post and coupler.

Stated in another way, as the post section end and the coupler progressively approach, any initial contact is between a curved edge of the coupler projection with the flat end edges of the post section, smoothing and guiding the progressive contact and reducing any flat-edge to flat-edge contact.

Where the post coupler wraps around the post section end from the inside, the coupler then can be initially oriented slightly angularly to the inside of the post angle, with the projection engaging the inside surface of the post section leading the post section into the coupler. Exacting alignment of the post section to the coupler is not necessary, greatly facilitating the fitting of the coupler to the post section as they are advanced together.

Assembly of coupler to post sections is thus facilitated and enhanced.

Assembly of a shelving unit formed of such post coupler and post sections is facilitated. Moreover, since the projections of the coupler reach out longitudinally along the inside corner of the post sections between their flanges, greater stability between the coupled post sections is provided, resulting in an enhanced and rigid shelving unit.

Finally, it will be appreciated the ends of the respective coupler projections define the longitudinal extent of the entire coupler. The reverse bend flanges extend along the direction of the coupler's longitudinal extension but are shorter than the overall coupler length and terminate short of the projections, thus not interfering with initial post section movement toward final seating within the coupler.

These and other features and advantages of the invention will be further readily understood from the following written description and from the drawings in which:

DETAILED DESCRIPTION OF THE INVENTION

Figure 1:
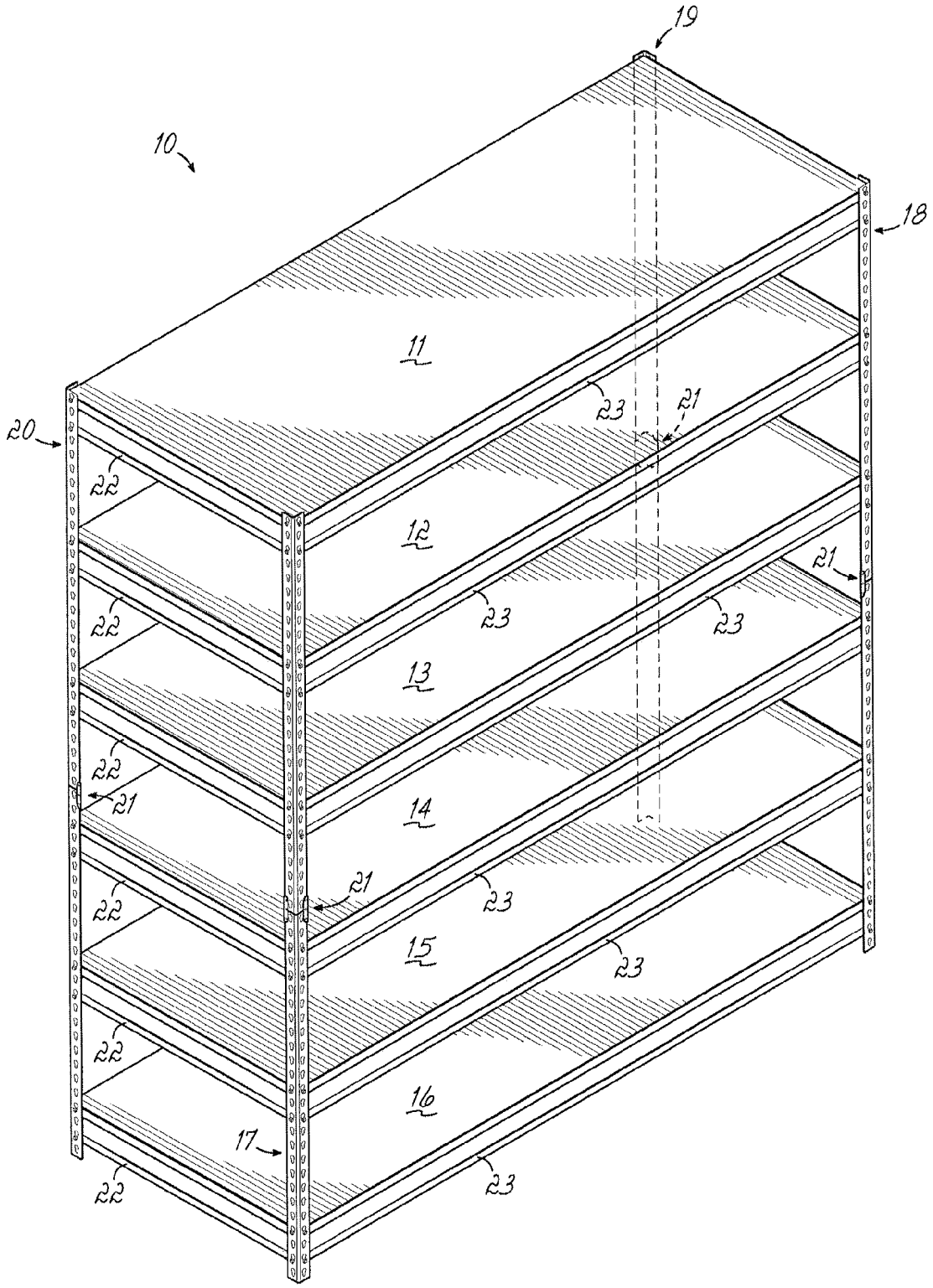
FIG. 1 is an isometric view of a shelving unit according to the invention.

For purposes of this application, the terms "inner", "inside" or "interior" refer to posts or coupler as viewed from within a shelving unit. The terms "outer", "outside" or "exterior" refer to post or coupler as viewed from without a shelving unit.

The coupler 21 best seen in FIGS. 2 and 3 comprises two major integral coupler flanges 50, 51 disposed at an included angle (at bend 56) to each other at preferably 90°, preferably similar to angle A between the post flanges 34, 35 as will be described.

Each major flange has a reverse bend or fold 52, 53 and an outwardly directed reverse bend flange 54, 55 respectively turned outwardly from respective flanges 50, 51, each flange 54, 55 lying parallel to the respective flanges 50, 51 from which they extend, and along the outside of coupler 20.

Figure 6:
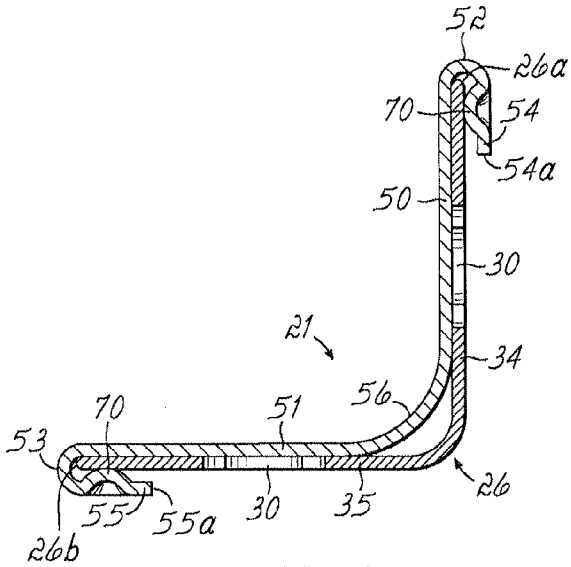
FIG. 6 is a cross-sectional view taken along lines 6-6 of FIG. 5.
Figure 6A:
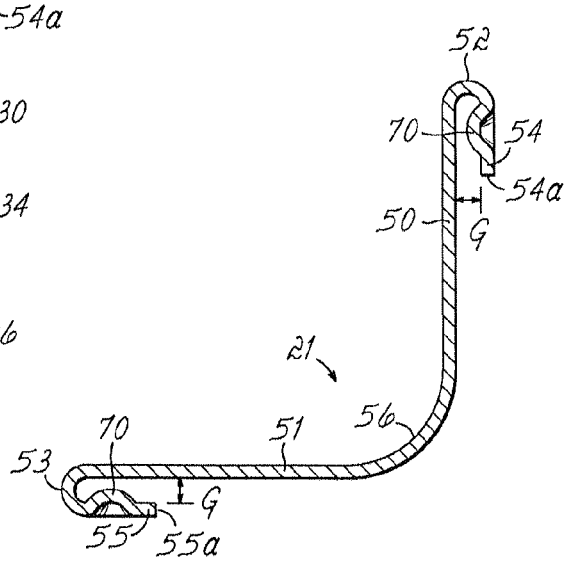
Figure 7:
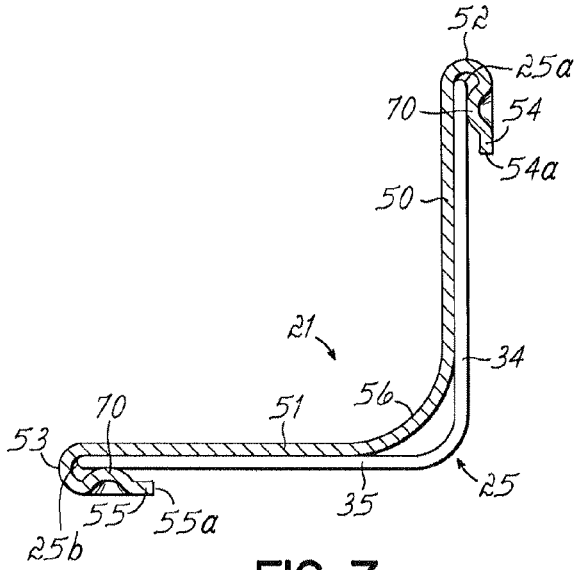
FIG. 7 is a cross-sectional view taken along lines 7-7 of FIG. 5.
Figure 9:
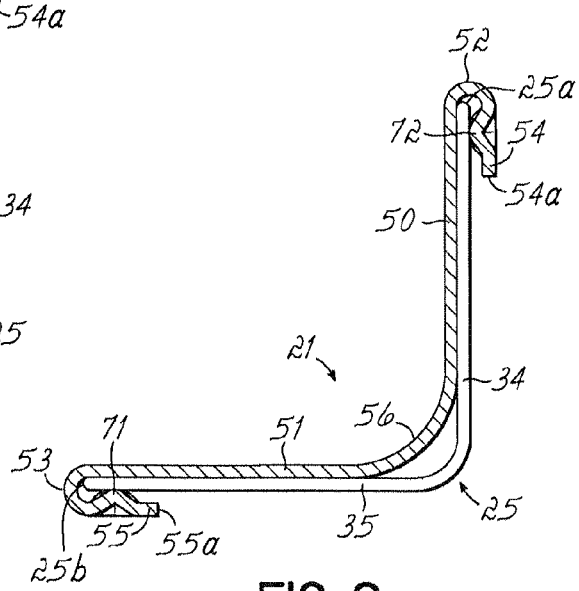
FIG. 9 is a cross-sectional view taken alone lines 9-9 of FIG. 8.

A gap G (FIG. 6A) is defined by the respectively adjacent flanges 50, 54 and 51, 55 respectively, this gap being approximately equal to the thickness of a post flange as will be described.

At each end of the bend 56, the coupler 21 includes a longitudinally protruding and rounded projection 58, 59 projecting outwardly from the ends 50*a*, 51*a* of flanges 50, 51 proximate bend 56. Each projection 58, 59 is an extension of flanges 50, 51 and each includes at each coupler end, the end edges 60 rounded or tapering toward the outer portion of the major flanges 50, 51. The ends or outer edges 60, 61 of opposite projections 58, 59 define the longitudinal extent and length of the coupler 21. It will be appreciated the reverse bend flanges 54, 55 extend along the coupler 20 between the coupler ends defined by the projections 58, 59 but are shorter in longitudinal length than the overall coupler length. In this regard, each projection 58, 59 may have a linear edge portion but at its side edges is rounded or tapered.

Figure 11:
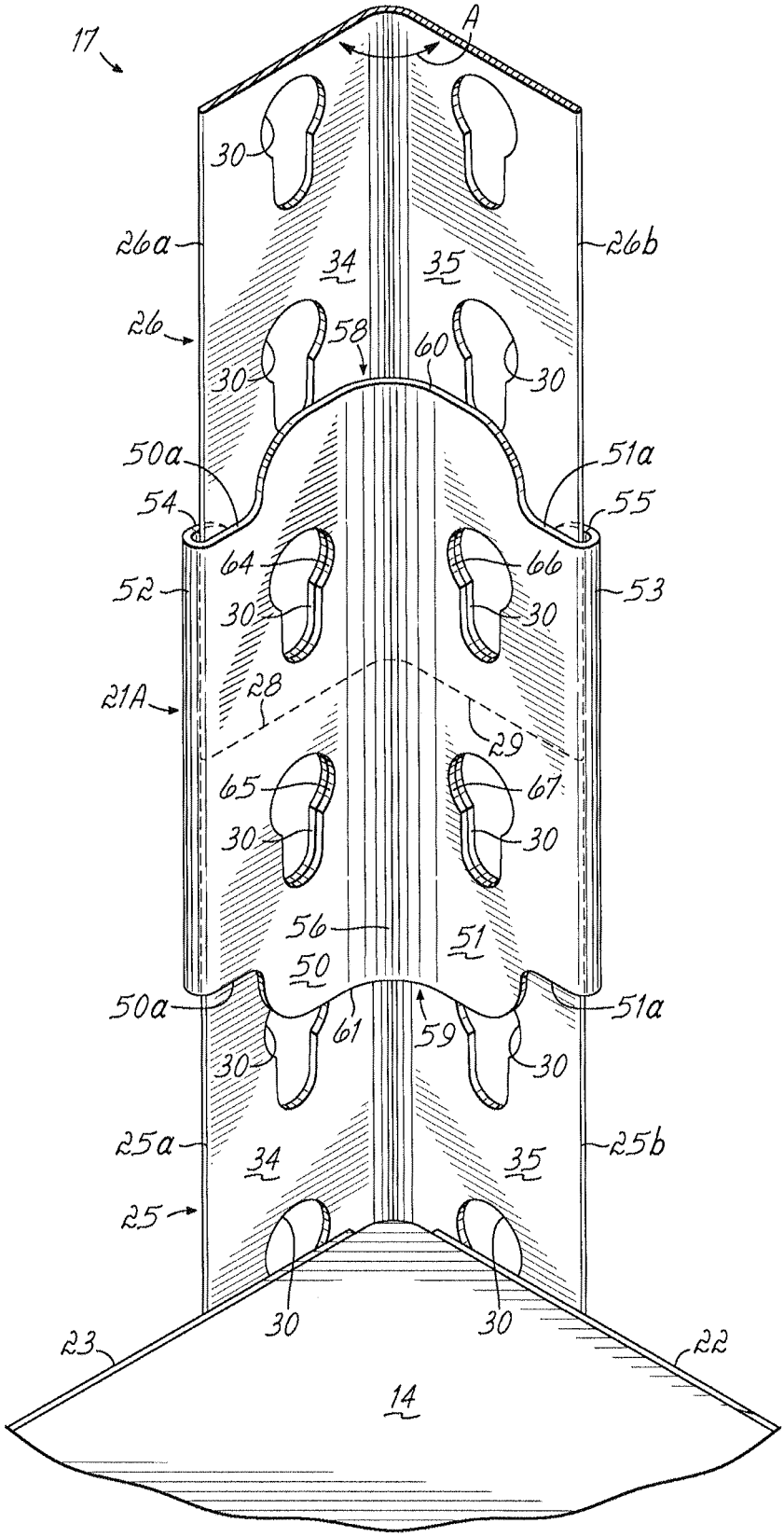
FIG. 11 is an isometric view similar to FIGS. 2 and 10, but showing an alternative coupler embodiment.
Figure 12:
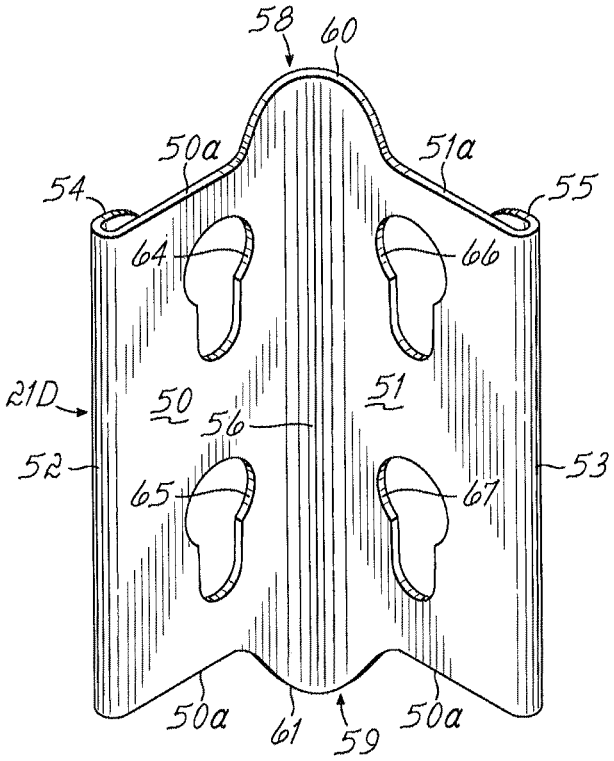
FIG. 12 is an isometric view of an alternate embodiment of the invention including fully rounded end projections.

In an alternate embodiment shown in FIG. 11, a coupler 21A is constructed as coupler 21, except coupler 21A also includes a plurality of keyhole-shaped apertures 64-67 as shown in FIG. 11, one above the other respectively, so apertures 64, 66 are respectively above apertures 65, 67 at the same distance or pitch as separate apertures 30 as will be described in the posts to be described. Apertures 64-67 are preferably in the same shape as the apertures 30 in the post sections.

Moreover, it will be appreciated that the reverse bend flanges have longitudinal edges which do not subtend said apertures, but are spaced laterally therefrom for the accommodation of rivets therethrough to connect shelf-supporting beams to said posts and at the position of said couplers.

Returning to FIGS. 1-7, coupler 21 is also provided with a plurality of detents or projections 70 in the respective reverse bend flanges 54, 55. These extend inwardly into the respective gaps G, and serve to frictionally engage post end sections (to be described) in gaps G when the post end sections are inserted into the coupler 21, as will be described.

In this regard, it will be appreciated the rounded or tapered projections 58, 59 serve to aid in the introduction of respective post end sections into the coupler. Thus, projections 58, 59 serve to help guide and facilitate the introduction of the post sections into coupler 21.

Finally, note the reverse bend flanges 54, 55 have respective elongated edges 54*a*, 55*a*. These define the return extent of flanges 54, 55 so the flanges do not extend over and block apertures 64-67. The reverse bend flanges 54, 55 thus do not subtend apertures 64-67, as would block them for passage of rivets therethrough as will be discussed.

Turning now to FIGS. 1-7, one embodiment of the invention comprises a shelf unit 10 having a plurality of shelves 11-16. Four composite corner posts or columns 17-20 define the corners of unit 10, each comprising at least two post sections (could be more) joined by a coupler as at 21. Each shelf 11-16 is supported by four horizontally-oriented shelf-supporting brackets or beams as at side beams 22, and front and rear beams 23, with front and rear beams 23 being longer than side beams 22. The rear beam and offside beams not shown in FIG. 1 are respectively identical to the front (23) and side (22) beams as shown in FIG. 1. Side beams 22 on one hand and the front/rear beams 23 on the other hand differ essentially only in length and are otherwise identical.

Figure 2:
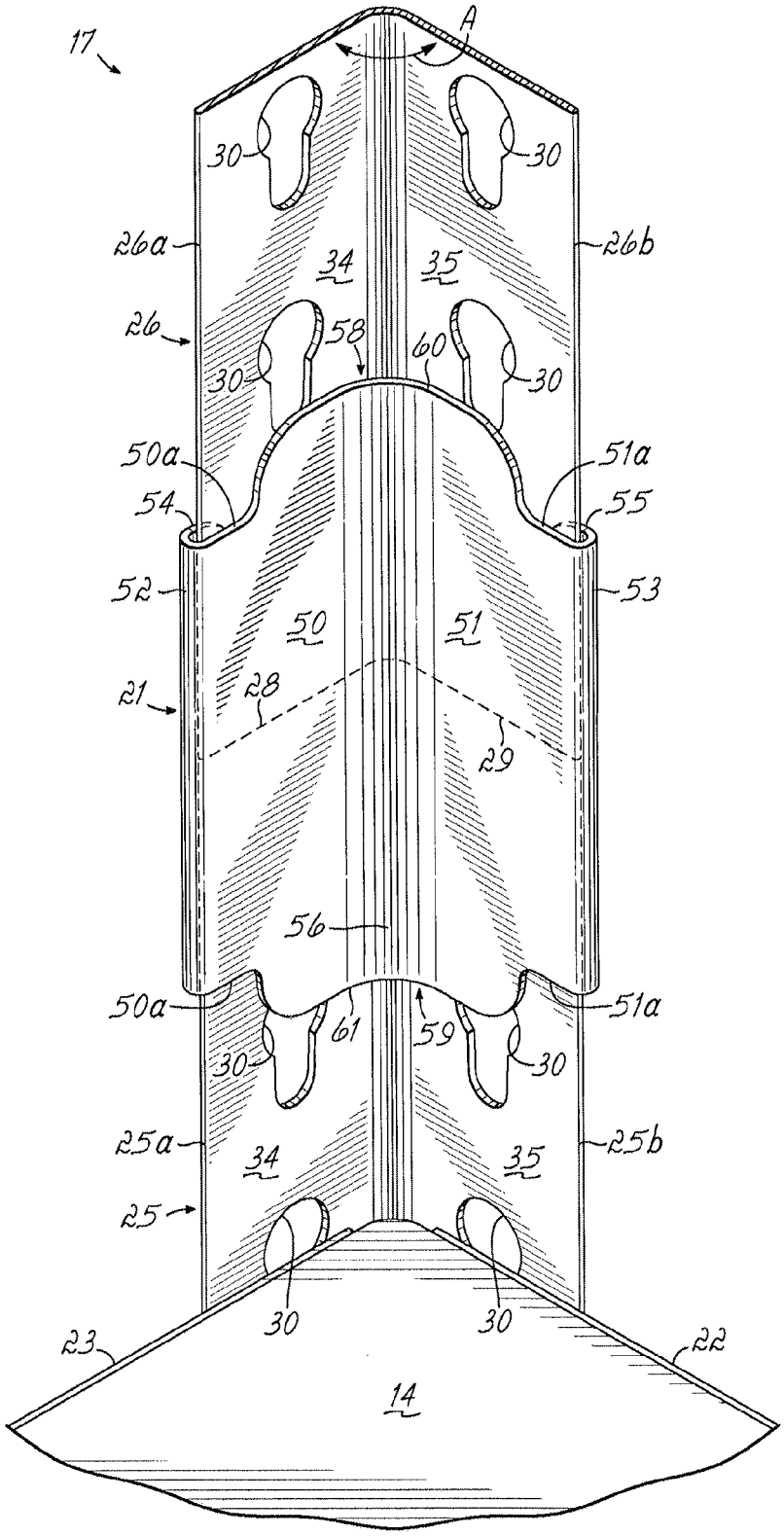
FIG. 2 is an enlarged isometric view of a portion 2 of FIG. 1 from the interior area of the shelving unit and at the juncture of post and coupler.

With attention to FIG. 2, there is shown from the perspective of the interior of the unit 10 a representative corner structure as at post 17, comprised of lower post section 25 and upper post section 26, coupled in end-to-end abutting relationship via coupling or coupler 21 to form a unitary post as at 17-20. The posts 17-20, post sections 25, 26, coupling 21, and the end structure of the beams at each corner of unit 10 are essentially identical, so only one corner structure, coupler, post section and beam intersection as in FIG. 2 will be described.

Each lower and upper post section 25, 26 is provided with a series of like keyhole-shaped apertures 30 as shown (FIGS. 1-5 and 8-11), each preferably identically spaced in each post section, one from the other. Preferably, but not always so, the endmost aperture 30 in each post section 25, 26 is spaced from the section ends at one-half pitch so that when sections 25, 26 are abutted, the two endmost apertures 30 are spaced from each other at the same pitch as each aperture 30 is spaced from other apertures 30 in the same post section. Apertures 30 have enlarged and narrower portions as shown.

Each post section 25, 26 is preferably in the form of a structural angle, formed by two post flanges 34, 35 at a preferred included angle A (FIG. 2) of about 90° with respect to each other. Each post flange has an elongated edge 26*a*, 26*b* and 25*a*, 25*b* respectively, as shown in FIG. 3.

It will be appreciated the reverse bends 52, 53 and their reverse bend flanges 54, 55 wrap around edges 26*a*, 26*b* and 25*a*, 25*b*, respectively, from the inside of the post around to the outside thereof as shown.

Post sections 25, 26 preferably abut each other end-to-end at section ends 28, 29.

As noted, beams 22, 23 are generally identical except for length in this embodiment; the length of such beams being variable to accommodate the width and depth of a desired shelving unit 10. These beams may be constructed as described in co-pending U.S. patent application Ser. Nos. 13/184,507 and 13/184,509 entitled "INSIDE WRAP POST COUPLER ACCOMMODATING BEAM RIVET (EDSM-55A) and "OUTSIDE WRAP POST COUPLER WITH ASSEMBLY ASSIST" (EDSM-51), both filed on even date herewith and incorporated expressly herein by reference.

Figure 3:
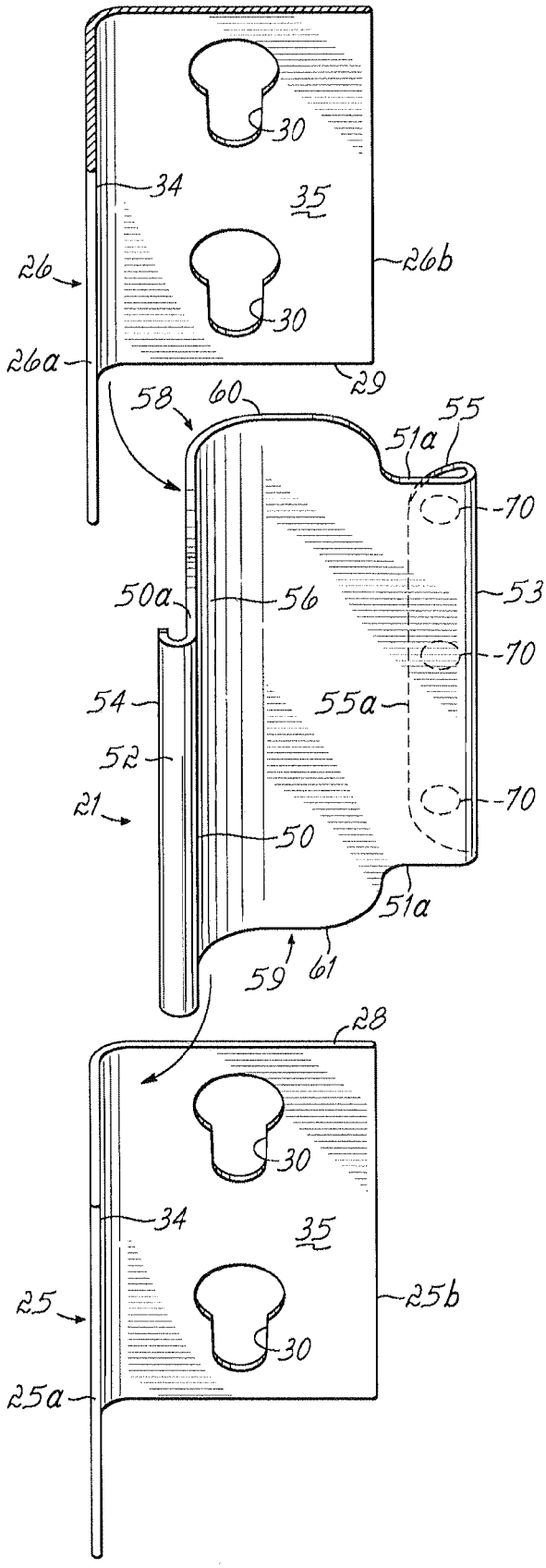
FIG. 3 is an isometric, exploded view of the coupler herein with two post sections.
Figure 4:
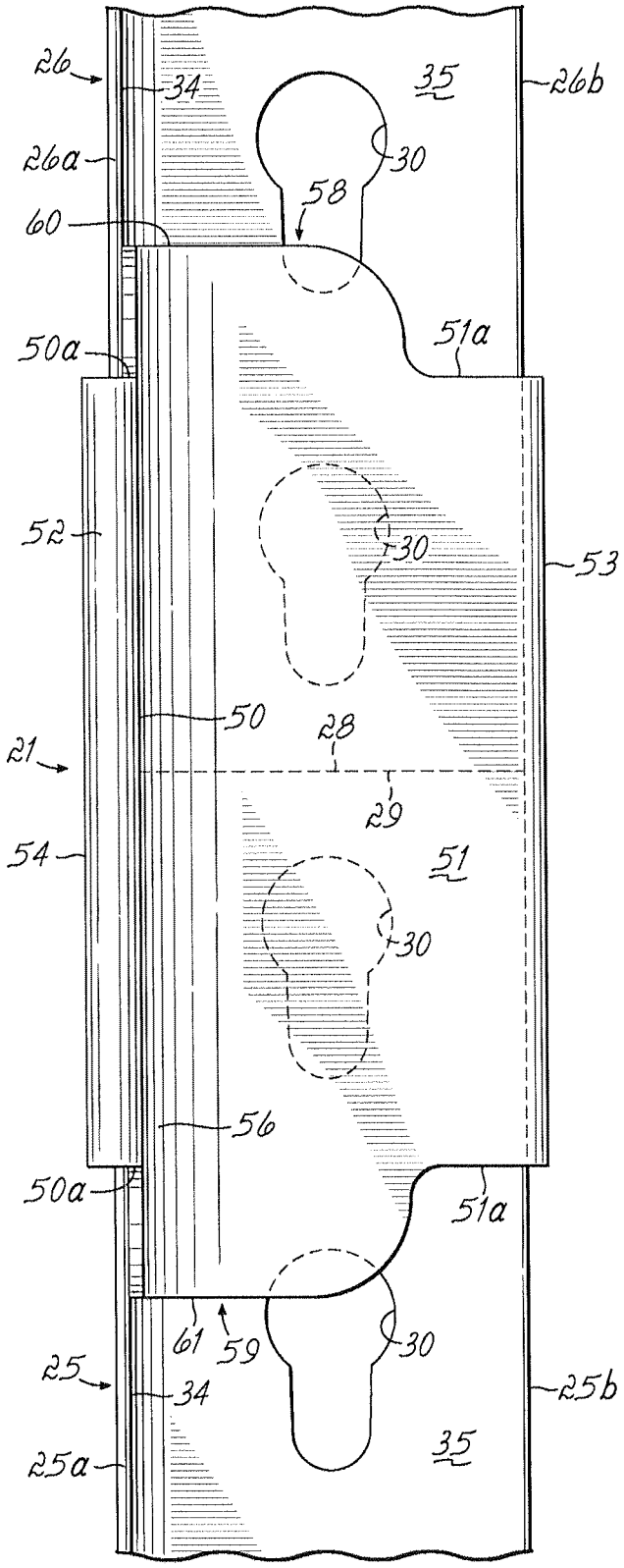
FIG. 4 is an elevational partial view from the inside of the shelving unit of FIG. 1 showing the coupler and post section.
Figure 5:
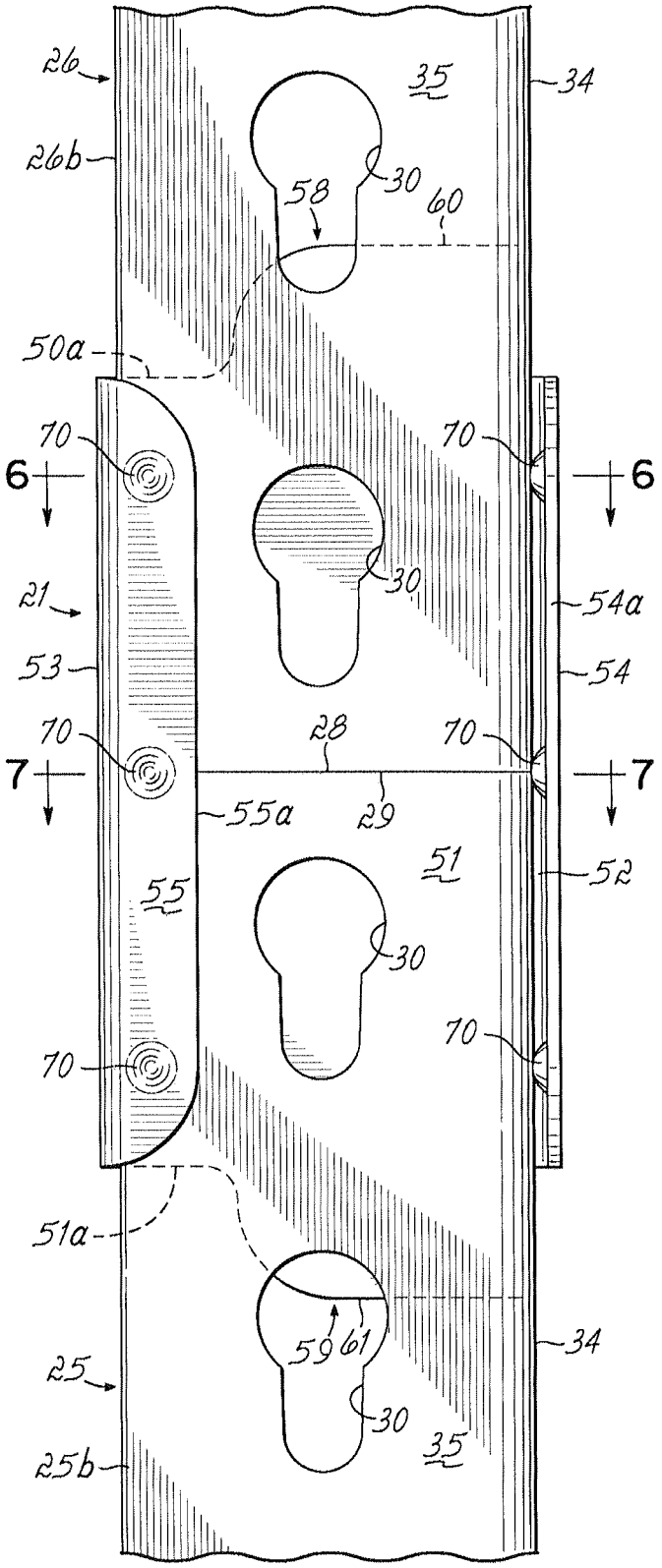
FIG. 5 is a partial elevational view from the outside of the shelving unit of FIG. 1 showing the coupler and post sections.

Referring to FIG. 3, coupler 21 is disposed proximate the bottom end 29 of upper post section 26, coupler 21 in secure contact with post section 26. Detents 65 frictionally engage and hold post section 26*a* in gap G, it being appreciated there is some flexibility in flanges 54, 55.

In the embodiment of FIG. 11, rivets (not shown) may be placed through post section 25, 26 and coupler 21 in order to secure them together in operative engagement with beams 22, 23 respectively.

The same is true of lower post section 25 respecting apertures 30 in lower post section 25 and the coupler apertures. It will here be appreciated that since edges 54*a*, 55*a* of coupler 21 do not block apertures 64-67 in coupler 21, any rivet heads may pass therethrough in the enlarged portions of the apertures to facilitate erection of shelving unit 10.

Accordingly, this invention contemplates a post coupler 21 in inside wrap form with flanges wrapping around the edges of an angular post from the inside and provide coupler end projections constructed to facilitate coupler engagement onto the post ends to be abutted. When corresponding apertures are provided in coupler 21*a*, the couplers accommodate beam supporting rivets without limit to the vertical beam position and shelves supported thereby within the height of the shelf unit corner posts including the areas where composite sections of the post are coupled.

More particularly and returning now to FIG. 2, in conjunction with the post section component, it will be appreciated that coupler 21 facilitates the assembly of post sections 25, 26 within coupler 21 to form a unitary corner post for the shelving unit 10. In particular, the projections 58, 59 are rounded or tapered, extending respectively in opposite directions from coupler 21 and more significantly from the corner structure 56 formed at the bend between coupler flanges 50, 51. It will be appreciated that as the flat edge 29 of post section 26 and coupler 21 are progressively engaged, the projection 58 easily engages the inside of the corner structure 56 of the post section 26, i.e. inside surfaces of flanges 50, 51. The post surfaces slide easily along the surfaces of the projection 58 and particularly the rounded portion, serving to smoothly guide and direct the relative movement of the coupler 21 and post section 26. Thereafter the coupler 21 and post section 26 are conformed together at the lateral edges 26*a*, 26*b* of the post section 26 easily introduced into the "slot" forming the upper mouth of the gap G, between the respective flanges 50, 51 and 54, 55.

The reverse bend flanges each terminate short of respective projections 58, 59 and do not obstruct or interfere with the relative initial motion of a post section end 28, 29 toward final seating as shown in the figures.

Moreover, it will be appreciated that the projection 58, lying along the inside corner structure 56 of post section 26 strengthens and supports section 26 within the coupler 21.

Of course, the similar construction and combination of projection 59 and post section 25 is likewise described.

Figure 8:
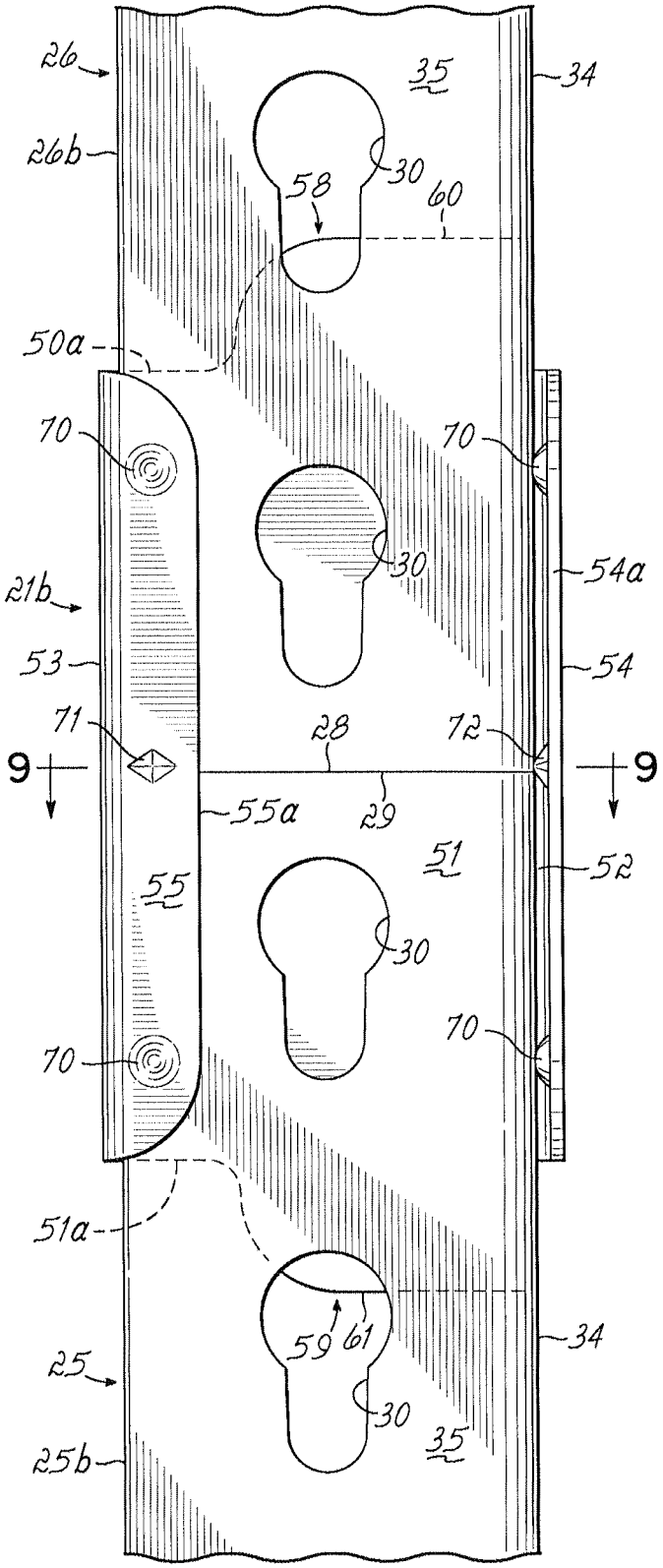
FIG. 8 is a partial elevational view from the outside of a shelving unit such as shown in FIG. 1 and illustrating two post sections with an alternative coupler.

In an alternate embodiment, shown in FIG. 8, the same inside to outside wrap coupler 21B is shown, the only difference being the centralized detents 71, 72 being in a diamond-shaped format (see FIGS. 8 and 9) rather than in the rounded detent format of detents 70 of FIGS. 3, 5, 6 and 7.

Otherwise, the structure and function of coupler 21B is like that of coupler 21.

Figure 10:
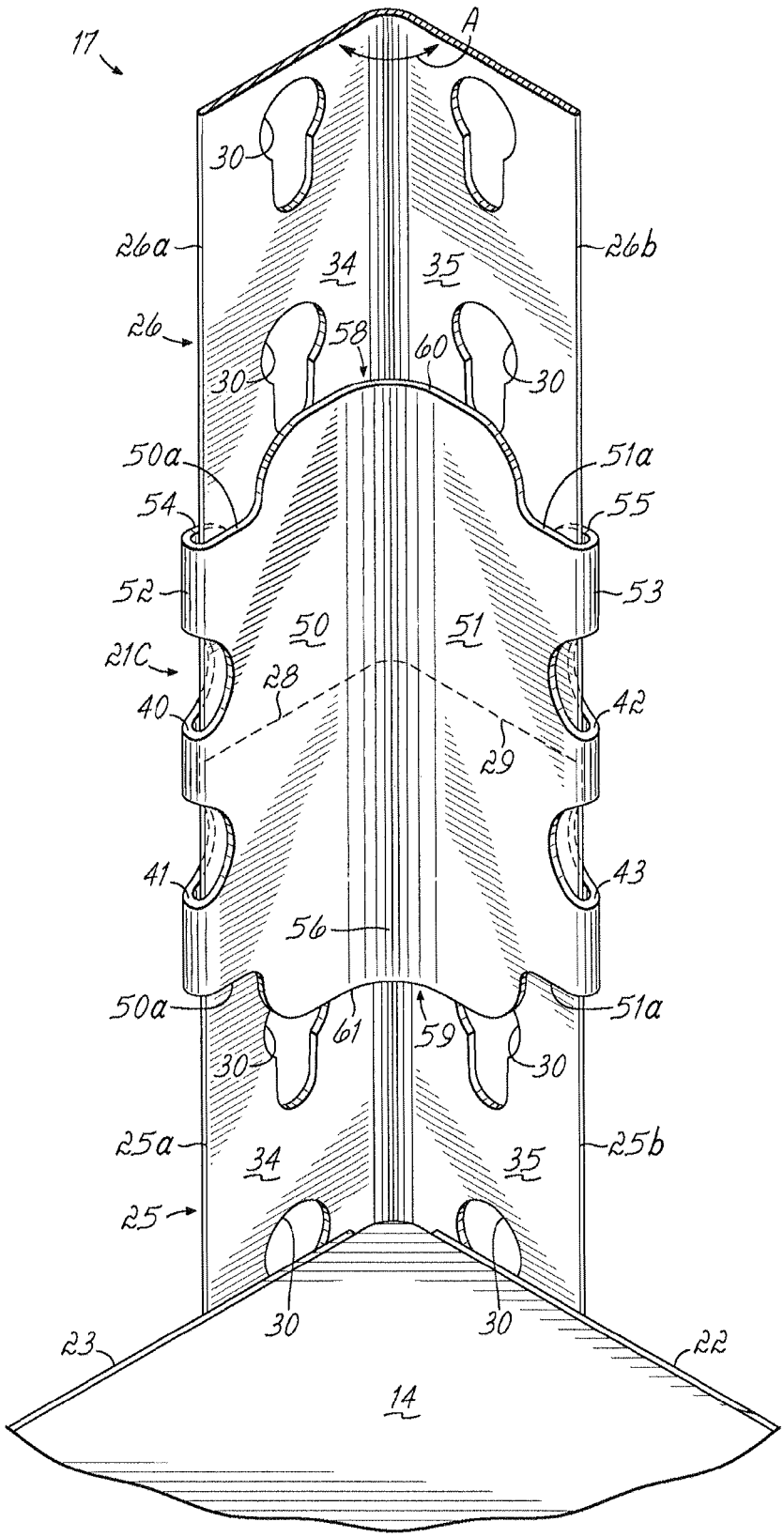
FIG. 10 is an isometric view similar to FIG. 2 but showing an alternate coupler embodiment.

In a yet further embodiment of the invention, shown in FIG. 10, a coupler 21C is exactly like that coupler 21, excepting for the provision of cut-outs 40-43. Cut-outs 40, 41 are oriented in respective flanges 50, 54 at bend 52, while cut-outs 42, 43 are oriented in respective flanges 51, 55 at bend 53. These cut-outs are open to post section edges 26*a*, 25*a* (cut-outs 40, 41) and post section edges 26*b*, 25*b* (cut-outs 42, 43). The cut-outs comprise half-moon relieved sections in the respective flanges 50, 51 and 54, 55. This coupler 21C could be provided with key-shaped apertures as coupler 21A in FIG. 11.

As a result, the support provided by coupler 21 to post sections 25, 26 is enhanced, and a more rigid, desirable corner post 17-20 is provided, resulting in a more rigid and stable shelving unit 10.

It will also be appreciated that as in the aforesaid application made a part hereof, the various shelf support beams could be attached to the respective post sections 25, 26 at positions corresponding to the coupler location of coupler 21A in FIG. 11, any mounting rivets extending through the various corresponding apertures in the post sections 25, 26, the coupler 21A and the generally horizontal beams 22, 23, whether mounted on the inside or the outside of the post structures.

These and other modifications and variations of the invention will be readily appreciated by the foregoing to those of ordinary skill in the art without departing from the scope of the invention and applicant intends to be bound only by the claims appended hereto.

What is claimed is:

1. A coupler for use in coupling together end-to-end abutting sections of post sections to form a composite post, each said post section including a pair of flanges intersecting at an angle, said coupler comprising:

a pair of coupler flanges also intersecting each other at said angle, each coupler flange having an exterior surface;

a reverse bend flange extended transversely from an edge of each coupler flange alongside a respective coupler flange and defining a gap with said exterior surface of said respective coupler flange;

each reverse bend flange having respective end edges;

a projection extending longitudinally from each end of each said coupler flange, each said projection having an end edge tapering non-linearly into a respective end edge of each reverse bend flange; and each said reverse bend flange extending longitudinally with each respective coupler flange and having a length shorter than a distance between respective end edges of said projections; and wherein each said projection end edge is rounded.

2. A coupler as in claim 1 wherein each said projection includes two integral sections, one extending from each coupler flange and intersecting together, at an angle, extending from said angle of intersection of said coupler flanges.

3. A shelving unit having a plurality of corner posts, a plurality of shelf-supporting beams connected to said corner posts and a plurality of shelves supported by said beams, said corner posts each comprising at least two vertically-oriented post sections comprising a pair of flanges intersecting at an angle, coupled together by a post coupler, said post coupler comprising:

a pair of coupler flanges also intersecting each other at said angle, each said coupler flange having an exterior surface and opposed ends;

a reverse bend flange extended transversely from an edge of said each coupler flange alongside a respective coupler flange and defining gap with said exterior surface of said respective coupler flange;

a projection extending longitudinally from each end of each said coupler flange, each said projection defining an at least partially curved end edge of said coupler tapering non-linearly into an end edge of a reverse bend flange; and said reverse bend flanges extending longitudinally with each respective coupler flange and having a length shorter than a distance between said partially curved end edges of said projections at each end of said coupler.

4. A shelving unit as in claim 3 wherein said coupler, in use, is oriented such that it wraps around said post flanges from the inside.

* * * * *